United States Patent [19]

Naia

[11] Patent Number: 4,600,101

[45] Date of Patent: Jul. 15, 1986

[54] BULB PACKAGING ARRANGEMENT

[75] Inventor: Michael Naia, Annandale, N.J.

[73] Assignee: Cooper Industries, Houston, Tex.

[21] Appl. No.: 693,598

[22] Filed: Jan. 22, 1985

[51] Int. Cl.[4] ..... B65D 85/42

[52] U.S. Cl. ..... 206/422; 206/45.12; 206/418; 206/486; 229/29 F; 229/DIG. 8

[58] Field of Search ..... 206/45.12, 45.19, 418–422, 206/486–490, 562; 229/29 F, 39 B, DIG. 8

[56] References Cited

U.S. PATENT DOCUMENTS

| | | | |
|---|---|---|---|
| 1,779,634 | 10/1930 | Neuner | 206/420 |
| 1,992,983 | 3/1935 | Anton | 229/29 F |
| 2,015,222 | 9/1935 | Hinson | 206/486 |
| 2,020,870 | 11/1935 | Benoit | 229/DIG. 8 |
| 2,593,689 | 4/1952 | Mitchell | 206/422 |
| 2,741,411 | 4/1956 | Olden | 206/422 |
| 2,946,498 | 7/1960 | Williamson | 206/419 |
| 3,182,885 | 5/1965 | Maio | 229/39 B |

FOREIGN PATENT DOCUMENTS

| | | | |
|---|---|---|---|
| 1536054 | 11/1969 | Fed. Rep. of Germany | 229/29 F |

*Primary Examiner*—William T. Dixson, Jr.
*Assistant Examiner*—Jimmy G. Foster
*Attorney, Agent, or Firm*—Eddie E. Scott; Alan R. Thiele

[57] ABSTRACT

A packaging arrangement for electric light bulbs wherein a plurality of bulbs are secured to a platform which is in turn slid into a protective carton for shipment or storage. The platform is formed from an integral blank and is provided with a plurality of bulb retaining sockets for mounting the bulbs on the platform. Each of the sockets is defined by a pair of parallel cuts in the blank connected at their ends by transverse score lines and bisected by a transverse cut extending beyond each of the parallel cuts. The resulting arrangement provides yieldable side flaps for the socket which are deflected by the bulb as it is inserted into the socket to firmly seat the bulb on the platform and a pair of opposing end flaps adapted to releasably secure the bulb within the socket.

10 Claims, 13 Drawing Figures

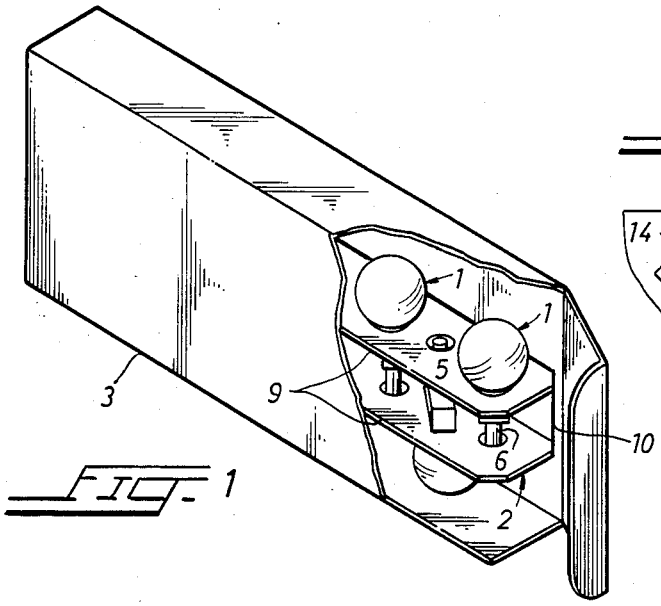
FIG. 1
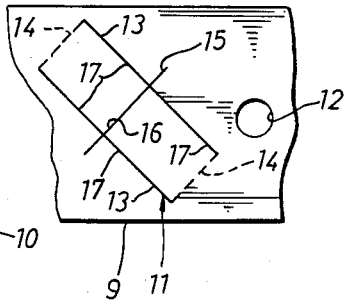
FIG. 3
FIG. 2
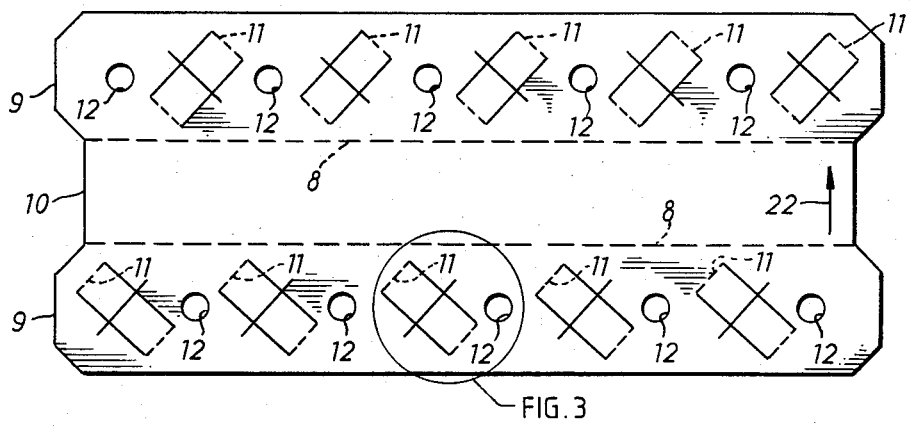
FIG. 4
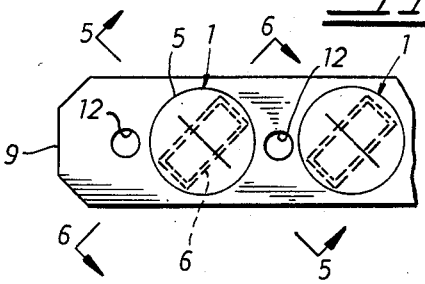
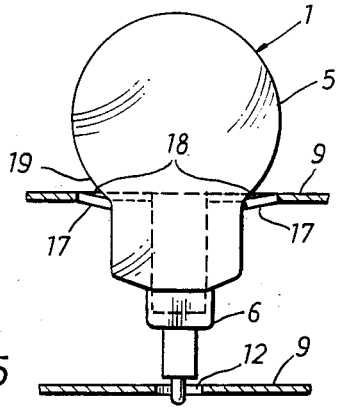
FIG. 5

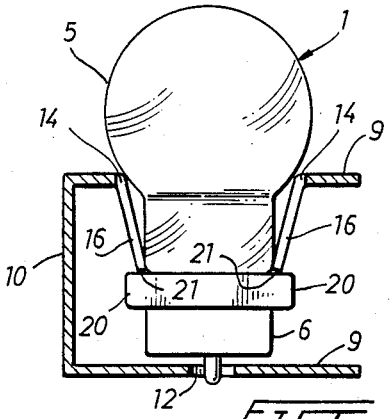
FIG. 6
FIG. 7
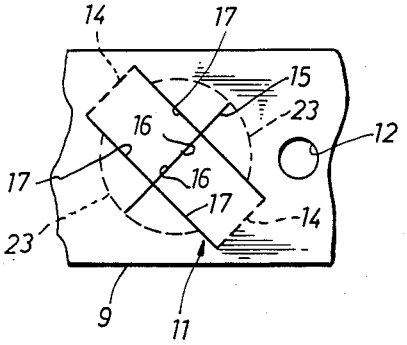
FIG. 8A
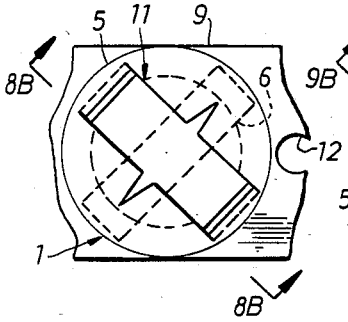
FIG. 9A
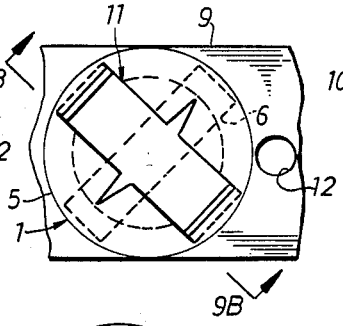
FIG. 10A
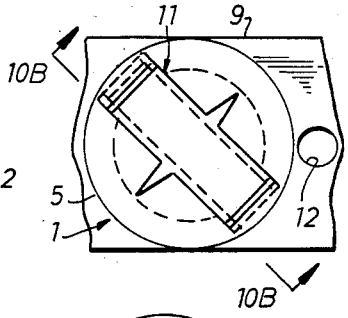
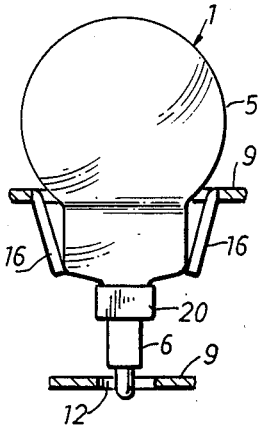
FIG. 8B
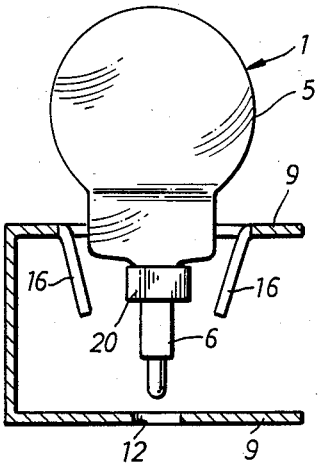
FIG. 9B
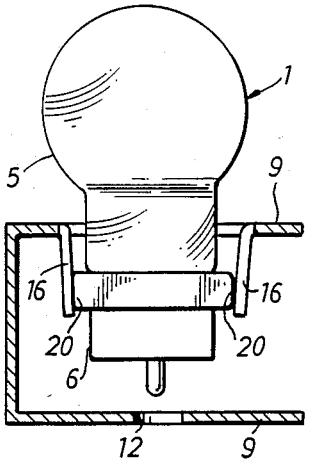
FIG. 10B

BULB PACKAGING ARRANGEMENT

BACKGROUND OF THE INVENTION

1. Field of Invention

This invention relates to merchandise packaging and in particular to a packaging arrangement for electric light bulbs and the like.

2. Description of the Prior Art

The prior art includes a variety of paperboard packaging arrangements for light bulbs and similar articles susceptable to breakage during shipment. For example, U.S. Pat. No 2,368,753 shows a package for a plurality of radio tubes formed of an integral blank or paperboard material folded to firmly secure both ends of each of the tubes within the package to protect them from shocks and jolts during shipment. While securing both ends of the tubes in this fashion adequately protects them from damage, the packaging operation is relatively complicated. Consequently, in the case of electric light bulbs and the like, it has been the practice to simply secure the base of the bulbs to a separate platform and then slide the platform into a protective carton. However, providing a straight-forward and easily manufactured means of firmly securing the base of the bulbs to the platform has continued to be a problem. Moreover, in many of the packaging arrangements currently in use, once the bulb is secured to the platform it is very difficult to remove it without damaging the means securing it to the platform. U.S. Pat. No. 2,015,222 shows a bulb clamping arrangement susceptible to this type of damage. In that arrangement cardboard tabs are wedged against the base of a light bulb in a fashion which would result in the tabs being torn when the bulb is removed.

SUMMARY OF THE INVENTION

The present invention relates to a packaging arrangement for electric light bulbs and the like and in particular to an arrangement wherein the bulbs can be secured and removed without damaging the packaging.

The invention provides for removably securing the bulbs to a platform which is in turn slid into a protective carton for shipment or storage. The platform, which is formed from an integral blank of paperboard or similar material, is provided with a plurality of bulb retaining sockets alternately disposed along the length of the platform. Each of the sockets is defined by a pair of parallel cuts in the blank connected at their ends by transverse score lines and bisected by a transverse cut extending beyond each of the parallel cuts. This forms a pair of opposing end flaps resiliently hinged along the transverse score lines and yieldable side flaps between the respective transverse score lines and the transverse cut. The arrangement enables a workman to insert a bulb into the socket so that the yieldable side flaps are deflected to form a pair of opposing mounting surfaces generally contiguous with the bottom surface of the envelope of the bulb to firmly seat the bulb on the platform while at the same time clamping the base of the bulb to the platform with the end flaps to removably secure the bulb to the platform. Thereafter, when it is desired to remove the bulb from the platform, the bulb is simply rotated to disengage the ends of the end flaps from the base, lifted part way out of the socket to a position where the base clears the ends of the end flaps, and then rotated back to its original position and withdraw from the platform.

From the foregoing, it can be seen that the invention contemplates a relatively straight-forward and easily assembled packaging arrangement which is particularly suited for electric light bulbs; however, it is to be understood that various changes can be made in the arrangement, form and construction of the apparatus disclosed herein without departing from the scope and spirit of the invention.

DESCRIPTION OF THE DRAWINGS

FIG. 1 is a cut-away perspective view of the packaging arrangement embodying the invention;

FIG. 2 is a plan view of a paperboard blank cut and scored to form the bulb platform;

FIG. 3 is an enlarged fragmentary plan view of one of the bulb retaining sockets prior to securing one of the bulbs in the socket;

FIG. 4 is a partial side view of the bulb platform showing the bulbs secured to the platform;

FIG. 5 is a fragmentary cross-sectional view taken generally along line 5—5 in FIG. 4;

FIG. 6 is a fragmentary cross-sectional view taken generally along line 6—6 in FIG. 4;

FIG. 7 is a plan view similar to FIG. 3 showing an alternative embodiment of the bulb retaining socket;

FIG. 8A is an enlarged fragmentary plan view similar to FIG. 4 showing the bulb rotated 90 degrees within the bulb socket with the end flaps disengaged from the bulb;

FIG. 8B is a partial cross-sectional view taken generally along line 8B—8B in FIG. 8A;

FIG. 9A is a view similar to FIG. 8A showing the bulb partially withdrawn from the bulb platform;

FIG. 9B is a partial cross-sectional view taken generally along 9B—9B in FIG. 9A;

FIG. 10A is a view similar to FIG. 8A showing the bulb rotated back to its original position from the position shown in FIG. 9A to enable to the bulb to be withdrawn from the bulb platform; and FIG. 10B is a partial cross-sectional view taken generally along 10B—10B in FIG. 10A.

DESCRIPTION OF THE PREFERRED EMBODIMENT

Referring to FIGS. 1–4, the invention provides for removably securing a plurality of electric light bulbs 1 to a platform 2 and then sliding the platform into a protective carton 3 having end closure flaps 4. As shown in the drawings, the bulbs 1 are of a conventional and well known design including a glass filament envelope 5 and a base 6 projecting from the envelope of a generally rectangular cross-sectional configuration.

The platform 2 is formed from an integral blank 7 having a pair of parallel intermittant score lines 8. This arrangement accommodates folding the blank 7 long the score lines 8 into the U-shaped configuration shown in the drawings to form a pair of parallel mounting panels 9 separated by a base panel 10 sized to extend across the interior of the carton 3. In the embodiment shown, the integral blank 7 is made from a chip paperboard, or chipboard, although it is to be understood that any one of a variety of materials can be used provided they can be readily cut and scored and are of sufficient stiffness and resilience to function in essentially the same manner as the chip paperboard.

The integral blank 7 is provided with a plurality of bulb retaining sockets 11 aligned along the length of the mounting panels 9. As can be seen from the drawings, the bulb sockets 11 are alternatively disposed along the two mounting panels 9 with clearance holes or apertures 12 provided for the tips of the bulb bases 6. Each of the sockets 11 is defined by a pair of parallel cuts 13 in its respective mounting panel 9 which are connected at each of their ends by transverse score lines 14 and bisected by a transverse cut 15 extending beyond each of the parallel cuts 13. This forms a pair of opposing end flaps 16 resiliently hinged along the transverse score lines 14 and four yieldable side flaps 17 within each of the sockets 11.

As shown in FIG. 5, each of the bulb sockets 11 is sized to receive the base 6 so that upon insertion of the bulb 1 the yieldable side flaps 17 are deflected or bent inwardly to form a pair of opposing mounting surfaces 18 which are generally contiguous with the convex bottom surface 19 of the envelope 5. This dent or depression formed by the mounting surfaces 18 facilitates firmly seating each of the bulbs 1 on its respective mounting panel 9 to stabilize it on the platform 2. The bulbs 1 are secured to the platform 2 by the opposing end flaps 16 as the bases 6 are inserted into the mounting panels 9. As shown in FIG. 6, the end flaps 16 are hinged along the transverse score lines 14 such that the inherent resiliency of the chipboard causes the end flaps to spring back toward the envelope 5 in a fashion securing the outwardly projecting side portions 20 of the base beneath the ends 21 of the end flaps as the envelope is moved into position within the depression formed by the mounting surfaces 18.

When it is desired to remove the bulb 1 from the platform 2, the bulb is simply rotated 90 degrees to the position shown in FIGS. 8A and 8B, lifted within the bulb socket 11 to the position shown in FIGS. 9A and 9B, and then rotated back to its original position as shown in FIGS. 10A and 10B from where the bulb can easily be withdrawn from the platform. As is readily apparent, this arrangement enables a retailer or customer to easily remove one of the bulbs from the platform and then resecure it without damaging the packaging.

Again referring to the drawings, the rectangular bases 6 are secured to the platform 2 at an acute angle of about 45 degrees to the intermittant score lines 8. This is done to minimize the size of the carton 3 necessary to enclose the bulbs once they are mounted on the platform. Additionally, this reduces the chance of the end flaps being torn along the transverse score lines. For example, in the embodiment shown the grain the fibers in the chipboard forming the integral blank extends transversely of the blank as generally indicated by the arrow 22. By aligning the tranverse score lines 14 at an acute angle to the grain, as opposed to straight across the grain, the arrangement maintains the strength and resilience of the hinged joint along the transverse score lines while reducing the chance of the end flaps simply breaking off along their respective score lines as the base of the bulb is inserted into the platform.

FIG. 7 shows an alternative embodiment wherein the same numerals indicate essentially the same elements as shown in FIGS. 1–6. This embodiment functions in generally the same fashion as the foregoing embodiment except that a pair of curved or arcuate score lines 23 are formed in the mounting panels 9 to more clearly define the bend lines of the side flaps 17 forming the mounting surfaces 18. This arrangement is particularly appropriate in the packaging of larger, heavier bulbs where thicker and stiffer blank material must be used to form the platform.

I claim:

1. A packaging arrangement for a bulb including an envelope having a convex bottom surface and a mounting base having opposite side portions projecting outwardly from the envelope, comprising:

a platform formed of an integral blank folded to form a mounting panel and a base panel;

a bulb retaining socket formed in the integral blank defined by a pair of parallel cuts in said mounting panel connected at each of their ends by a transverse score line and bisected by a transverse cut extending beyond each of the parallel cuts to form a pair of opposing end flaps resiliently hinged along said transverse score lines and yieldable side flaps between the respective transverse score lines and the transverse cut;

said bulb retaining socket being sized to receive the base of the bulb so that upon insertion of the bulb into the socket the yieldable side flaps are deflected to form a pair of opposing mounting surfaces generally contiguous with the bottom surface of the envelope and the end flaps overlie the side portions to removably secure the bulb to the platform; and a carton sized to encapsulate the platform with the bulb thereon.

2. The packaging arrangement of claim 1, and said integral blank having a pair of parallel score lines and being folded into a generally U-shaped cross-sectional configuration along said score lines to form said base panel between said score lines and a pair of said mounting panels outwardly of said score lines.

3. The packaging arrangement of claim 2, and a plurality of said bulb retaining sockets alternately disposed along the opposing mounting panels.

4. The packaging arrangement of claim 3, and each of said mounting panels having a clearance aperture transversely aligned with each of the bulb retaining sockets in the other mounting panel.

5. The packaging arrangement of claim 3, and said parallel cuts extending at an angle of about 45 degrees to said parallel score lines and said transverse score lines and transverse cut extending at right angles to said parallel cuts.

6. The packaging arrangement of claim 1, and said integral blank being formed of a paperboard material.

7. The packaging arrangement of claim 1, and said integral blank being formed of chip paperboard and said transverse score lines extending at an acute angle to the fiber grain of said chip paperboard.

8. The packaging arrangement of claim 7, and said integral blank having an intermittent score line extending across it and being folded along said score line to form said mounting and base panels.

9. The packaging arrangement in claim 1, and said mounting panel having arcuate score lines defining said side flaps.

10. The packaging arrangement of claim 1, and said mounting base being of a generally rectangular cross-sectional configuration.

* * * * *